United States Patent [19]

Burgmann

[11] Patent Number: 5,077,547

[45] Date of Patent: Dec. 31, 1991

[54] NON CONTACT PROGRAMMING FOR TRANSMITTER MODULE

[75] Inventor: Thomas A. D. Burgmann, Mississauga, Canada

[73] Assignee: Dicon Systems Limited, Toronto, Canada

[21] Appl. No.: 489,334

[22] Filed: Mar. 6, 1990

[51] Int. Cl.[5] ..... G08B 23/00; G08B 1/00

[52] U.S. Cl. ..... 340/501; 340/506; 340/539; 340/518; 340/531; 340/825.72; 235/382.5

[58] Field of Search ..... 340/501, 539, 506, 531, 340/825.69, 825.72, 825.06, 518, 825.31, 825.34; 235/382.5

[56] References Cited

U.S. PATENT DOCUMENTS

| | | | |
|---|---|---|---|
| 4,581,606 | 4/1986 | Mallory | 340/539 |
| 4,652,860 | 3/1987 | Weishaupt et al. | 340/539 |
| 4,737,770 | 4/1988 | Brunius et al. | 340/539 |
| 4,801,924 | 1/1989 | Burgmann et al. | 340/539 |
| 4,859,990 | 8/1989 | Isaacman | 340/539 |
| 4,908,604 | 3/1990 | Jacob | 340/539 |

*Primary Examiner*—Donnie L. Crosland

*Attorney, Agent, or Firm*—Lee, Mann, Smith, McWilliams & Sweeney

[57] ABSTRACT

Method and apparatus for programming sensors in a security system comprising a central monitor for generating a localized magnetic pulse signal, and one or more sensors each incorporating a magnetic switch for sensing the magnetic pulse signal generated by the central monitor and in response enabling programming of the sensor with data encoded within the magnetic pulse signal.

19 Claims, 3 Drawing Sheets

NON CONTACT PROGRAMMING FOR TRANSMITTER MODULE

FIELD OF THE INVENTION

This invention relates in general to security alarm systems, and more particularly to a method and apparatus for programming one or more sensors in a security alarm system with data generated by a central monitor.

BACKGROUND OF THE INVENTION

Security alarm systems are becoming increasingly popular in residential communities. The most common form of sensor in residential areas and homes is the well known fire and smoke detector. However, there has been increased use in residential areas of intrusion or burglar alarms and also devices which monitor the status of various appliances in the home, such as water heaters, furnaces, freezers and the like. Similar alarm systems are, of course, used in industry. As the systems are expanded at each installation, it becomes more and more important to have a central monitoring device which determines the status of all of the sensors to ensure that they are operative at all times and which is to be located in an area such that, when an alarm is sounded, the type of alarm and its whereabouts can be determined.

This has resulted in the demand for a central monitor which can communicate with all forms of sensors in a home or industrial installation. To accomplish this objective, transmitters have been devised for coupling with the various sensors and transmitting information to a receiver of a central monitor system. The information transmitted may identify the type of alarm and its location. In industrial applications, radio transmitters are not frequently used, because it is easy to install wiring to hook up the various sensors directly with the central monitor system. However in the home, wiring is unattractive and with the use of radio receivers and transmitters, the wiring is eliminated.

In residential applications, it is important to distinguish the security alarm system of one household relative to all adjacent households. This prevents a transmitter in one household transmitting an alarm condition and having it picked up by the neighboring household alarm system. To avoid this, each transmitter is coded with information, which not only identifies the particular alarm system, but also the sensor which is transmitting the alarm. This requires that some form of memory be provided with each transmitter and with the receiver. Presently this has been accomplished by use of a memory which is precoded before the unit is sold, offering little flexibility to the householder or alternatively by use of memories which may be coded by mechanically flipping switches. By using a predetermined format, the code for the system can be entered into the device by flipping the appropriate switches along with a code for the particular sensor being coupled with a transmitter. Such preprogrammed or limited mechanical switching program memories offer little flexibility and to the average consumer are difficult to program. Since the program is provided by way of switches, they can be accidentally altered or could be intentionally altered by an intruder into a household. In addition, the transmitters normally have their own power supply which is separate from the sensor.

The improvements in security systems, according to this invention, overcome the above problems in providing a far more flexible system to accommodate variations of each household and which can be readily installed by the consumer.

In most security alarm systems, there are a plurality of sensors for one or more of fire, smoke, intrusion, appliance operation and the like. It has been discovered that the preponderance of sensors in such security alarm systems are of the simple door/window contact variety. Such well known door/window contact monitors often incorporate an on board reed switch adapted to be actuated by movement of a proximity magnet carried by the door or window in the vicinity of the sensor.

A central monitor device monitors and is capable of perceptibly indicating the status of each of the sensors. Individual transmitters are provided for each of the sensors for transmitting information from a respective sensor to a receiver associated with the central monitor. The central monitor processes the transmitted information to indicate perceptibly the status of the respective sensor causing transmission of the information. A memory is associated with each transmitter and with the receiver for storing information. This enables the monitor to recognize information transmitted by a respective transmitter of its system, as actuated by a corresponding sensor, to identify the status of the sensor.

According to one prior art security alarm system described in U.S. Pat. No. 4,581,606, each of the sensor modules is programmed by means of a portable data loading module having an electrical coupler for connecting to a multiple pin connector on the sensor. The dimensions of the sensor modules in this prior art system are necessarily quite large in order to accommodate the multiple pin programming connector. Furthermore, the aforementioned data loading means is incorporated within the central monitor, resulting in a cumbersome procedure for programming the various sensor modules requiring physically transporting the central monitor to each individual sensor to be programmed.

SUMMARY OF THE INVENTION

The improvement, according to this invention, comprises non contact programming means for loading information data into an electronic memory for each of the sensors and into an electronic memory associated with the receiver. The central monitor is provided with means for generating a magnetic pulse signal containing the information data. Each sensor is provided with a reed switch for sensing the localized magnetic pulse signal and in response storing the information data signal within the internal electronic memory.

According to the present invention, the reed switch normally found in such sensors is used for the dual purpose of detecting movement of the proximity magnet when functioning in an operating mode, as well as for detecting a magnetic pulse signal when the sensor is functioning in a program mode.

Thus, the sensor modules in a security system according to the present invention may be made of significantly reduced size compared to prior art systems as a result of the ability to eliminate multiple pin programming connectors associated with prior art sensors, as well as the economies provided by utilizing the reed switch in a dual function.

Thus, in general, according to the present invention there is provided:

A method for non contact programming of a first device having memory means in accordance with a data signal produced by a second device, comprising the steps of:

a) generating at said second device a localized electromagnetic pulse signal corresponding to said data signal;

b) positioning said first device relative to said second device so as to effect electromagnetic coupling therebetween; and c) sampling and detecting said electromagnetic pulse signal at said first device and in response decoding and storing said data signal in said memory means, whereby said first device becomes programmed in accordance with said data signal.

In accordance with a further aspect of the present invention there is provided:

In a security alarm system comprising a central monitor and one or more programmable sensors, the improvement comprising:

a) means within said central monitor for generating a localized magnetic pulse signal defining data to be stored within said one or more sensors b) a reed switch within each said one or more sensors for sensing said localized magnetic pulse signal; and c) means within each said one or more sensors for decoding said data from said electromagnetic pulse signal sensed by said reed switch and in response programming said sensor in accordance with said data.

BRIEF DESCRIPTION OF THE DRAWINGS

A preferred embodiment of the present invention will be described in greater detail below with reference to the following drawings in which.

DETAILED DESCRIPTION OF THE PREFERRED EMBODIMENTS

Figure 1:
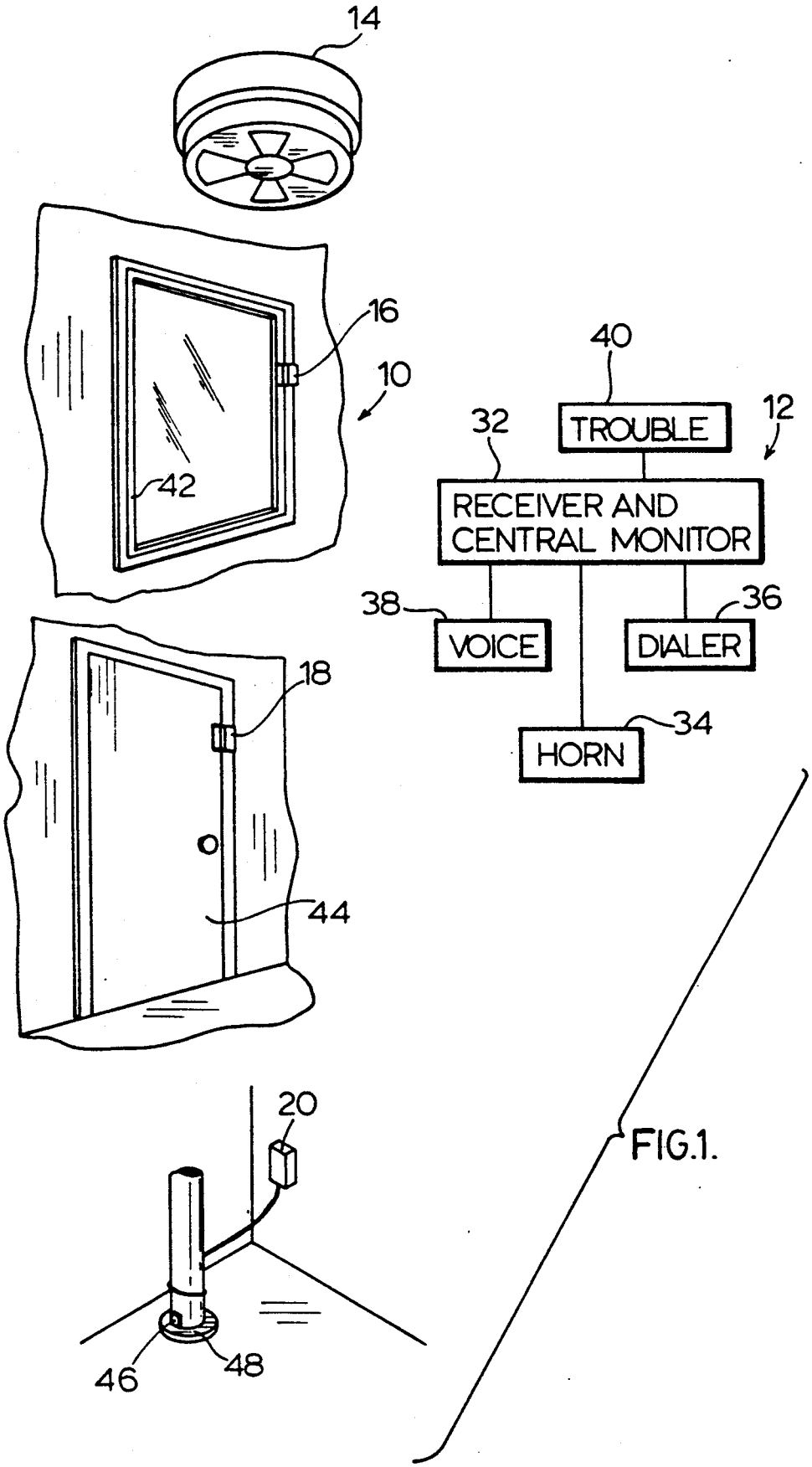
FIG. 1 is a schematic representation of a security alarm system having a plurality of sensors and a central monitor system.

FIG. 1 schematically represents a security alarm system 10 comprising a central monitor 12 and a plurality of sensors 14, 16, 18 and 20. Each sensor is specific to fire, window entry, door entry and detection of high water level in a basement sump area. Obviously, there are many other applications for sensors, particularly in the household, for sensing the status of appliances such as freezers and refrigerators as well as the supply of gas to gas fired water heaters, furnaces and the like.

The central monitor 12 is typically incorporated within a cabinet, as described in greater detail below with reference to FIG. 2, and can actuate an outside horn 34, a telephone dialer 36, a voice synthesizer 38 and a trouble indicator 40.

For example, sensor 14, upon sensing smoke in a room, actuates an internal transmitter to signal the central monitor 12 for causing the appropriate alarm or dialling the appropriate emergency number.

Similarly, the opening of window 42 and door 44 are detected by sensors 16 and 18 which actuate their respective internal transmitters for generating appropriate signals to the central monitor.

With the detector leads 46 in the sump area 48, a high water level is detected to actuate sensor 20 and in turn cause an internal transmitter to generate a signal to the central monitor and cause a trouble alarm at 40.

Each of the sensors 14, 16 and 18 incorporates an electronic memory which stores the particular coded information to identify the sensor that the transmitter is associated with and to provide a code which identifies the alarm system that the transmitter belongs to. As can be appreciated, the central monitor system must be able to recognize only its own transmitters and not those of some other building. Thus, each transmitter memory is loaded with a code to identify the system.

According to the present invention, the end user is given the opportunity to program his or her security system with their own system code, as well as being able to individually program respective ones of the sensors. This is in contrast to other prior art security systems in which each transmitter is factory preprogrammed with a unique code. In such prior art systems, up to seven million combinations of code are accommodated.

The particular format of the information stored in the electronic memory of each sensor may vary depending on the number and type of sensors supported by the security system, as well as the number of bits of information required to identify a sufficiently large number of different system identification codes, etc.

In accordance with the preferred embodiment, each sensor is programmed with a 32 bit code plus configuration data resulting in a total of 48 bits stored within the internal memory.

Specifically, the 32 bit fixed code comprises 11 bits of system identification, 7 bits of module identification and 14 bits designated as check field I. These 32 bits of fixed data are not segmented by hardware but rather by software interpretation. Hence, the 32 bits may re-allocated to decrease the number of site codes (e.g. system identification) and increase the module codes (i.e. module identification) with only a minor change in the console program. With the above discussed planned partitioning, 2048 site codes and 128 modules may be defined via software. However, it will be appreciated to a person skilled in the art that any number of modules my be defined while still allowing a rudimentary error check field for parity.

The configuration data comprises 7 bits of status and 9 bits designated as check field II. The status bits define alarm states, battery level or auxilliary inputs. The check field II data is generated prior to transmission such that any errors in the status field can be corrected. The purpose of the check fields I and II is to provide an error correction mechanism and thereby reduce the number of repeated transmissions. With this scheme, a single transmission is all that is required to validate a complete a full message.

A better understanding of the invention and its operation may be obtained by considering the following example in which a predetermined one of the sensors, say sensor 16, is programmed by the central monitor 12.

Figure 2:
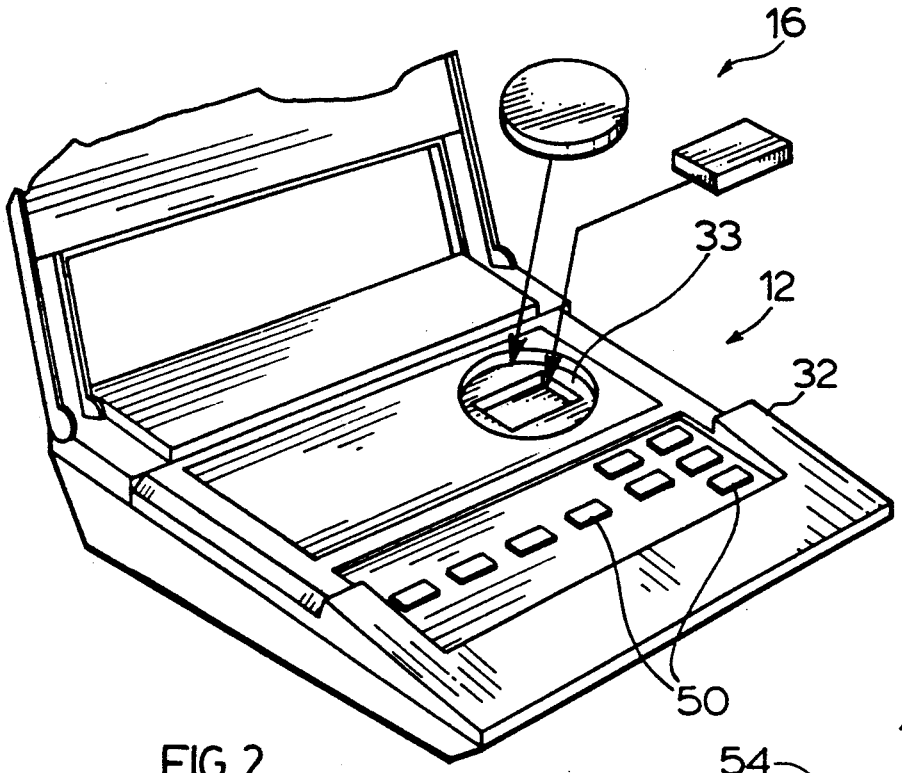
FIG. 2 is a perspective view of the central monitor system and a sensor positioned to undergo programming.

In order to load the information into the sensor, as shown in FIG. 2, the sensor 16 is placed in a shallow depression or recess 33 in the console 32. Next, a user initiates programming of the sensor 16 by depressing selected keys 50 on the console responsive to voice prompts generated by the central monitor 12 through a speaker (not shown).

The magnetic field generated by console 32 must be strong enough to reach a reed switch which is positioned within a couple inches within the console, even though not necessarily positioned within the recess depicted. In this way, smoke alarm sensors may be programmed by the console without resorting to the use of removable transmitters.

As will be described in greater detail with reference to FIGS. 3 and 4, the console 32 is provided with means for generating a localized magnetic field with a short range of approximately three centimeters. The magnetic field is pulse modulated to provide position data which is sensed by the reed switch incorporated within sensor 16 for programming the internal memory.

Initially, the console 32 generates non-data trigger pulses to be sensed by the reed switch of sensor 16. Upon detection and synchronization of the pulse signals, sensor 16 generates an RF response signal for reception by the central monitor 12. The console 32 then generates a further signal to verify the identity of the sensor 16. Upon completing such verification, the console then transmits a serial data signal via magnetic pulses, which data signal is received and decoded by the sensor 16 for programming the internal memory. Finally, the sensor 16 automatically retransmits the newly programmed data via RF transmission before confirming successful programming. The console 32 then alerts the user via the speaker that the sensor 16 is programmed and ready to be installed for operation.

According to the preferred embodiment of the present invention, the combined transmitter and sensor 16 can be sealed from the effects of moisture. However, on door/window transmitters, an optional terminal pair can be provided to allow for a programmed N.O. (normally open) or N.C. (normally closed) wired connection, or even an open collector transistor.

An important advantage of the present invention is the reduction in dimension of each sensor resulting from elimination of a multiple pin connector at the console 32 and all of the sensor modules. Accordingly, each sensor, whether remote key pad, door/window, medical pendant, motion or other can be significantly reduced in size.

Figure 3:
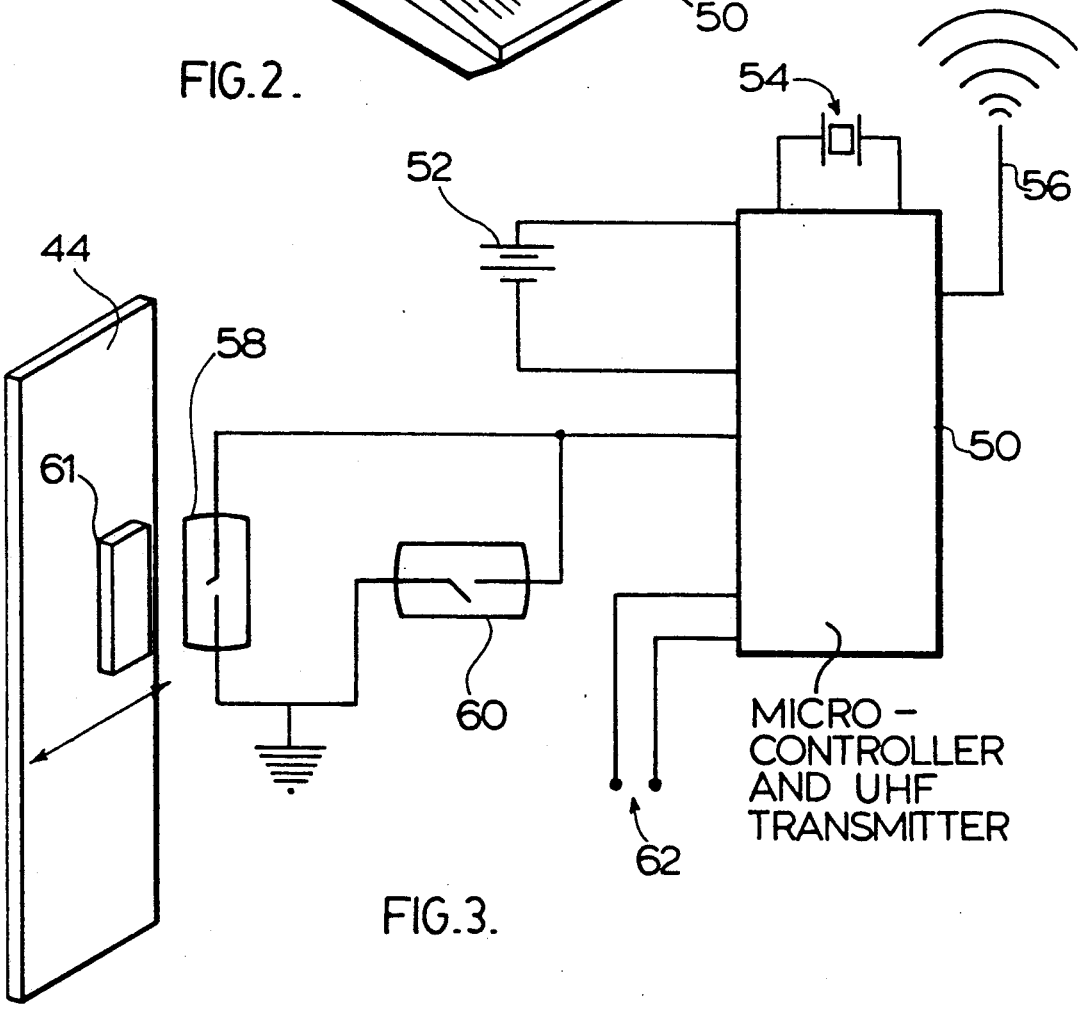
FIG. 3 is a schematic representation of a sensor module in accordance with the preferred embodiment.

The miniaturized sensor of the present invention is shown in greater detail with reference to FIG. 3. An integrated microcontroller and UHF transmitter 50 is provided with an external power supply 52 such as a battery, which can be located either externally or internally of the sensor module. The integrated microcontroller 50 also incorporates an on board memory such as an EEPROM capable of storing 40 bits of information and configuration data.

The microcontroller 50 is driven by a clock 54 in a well known manner. Furthermore, an antenna 56 is connected to the microcontroller 50 via a UHF transmitter port thereof.

According to the present invention, status information from the sensor is transmitted via radio frequency. It is understood, however, that information may also be transmitted through the air by using other forms of electromagnetic radiation, such as ultrasonic and infrared. In addition, the signal may be transmitted through existing household wiring.

As discussed above, each sensor is also provided with a reed switch which, in accordance with the preferred embodiment, comprises a pair of orthogonally disposed reed sensors 58 and 60 located adjacent respective side surfaces of the sensor module for sensing changes in the magnetic field. These changes can result from the physical movement of a magnet 61 in the vicinity of the reed switch, such as in the case of a window or door opening during normal operation, or as a result of a pulsating electromagnetic field, such as generated by the console 32 (FIG. 2) during programming of the sensor.

As discussed above, the sensor may also be provided with an optional external device screw terminal 62 for providing programmed wired connection to a contact switch, etc.

In addition to the reed switch, and in place of the magnet 61, the sensor may be provided with smoke detection circuitry, moisture detector leads, etc., depending on the required application. However, each sensor 14, 16, 18 or 20 will be provided with at least the reed switches 58, 60 for the purpose of programming the sensor.

Figure 4:
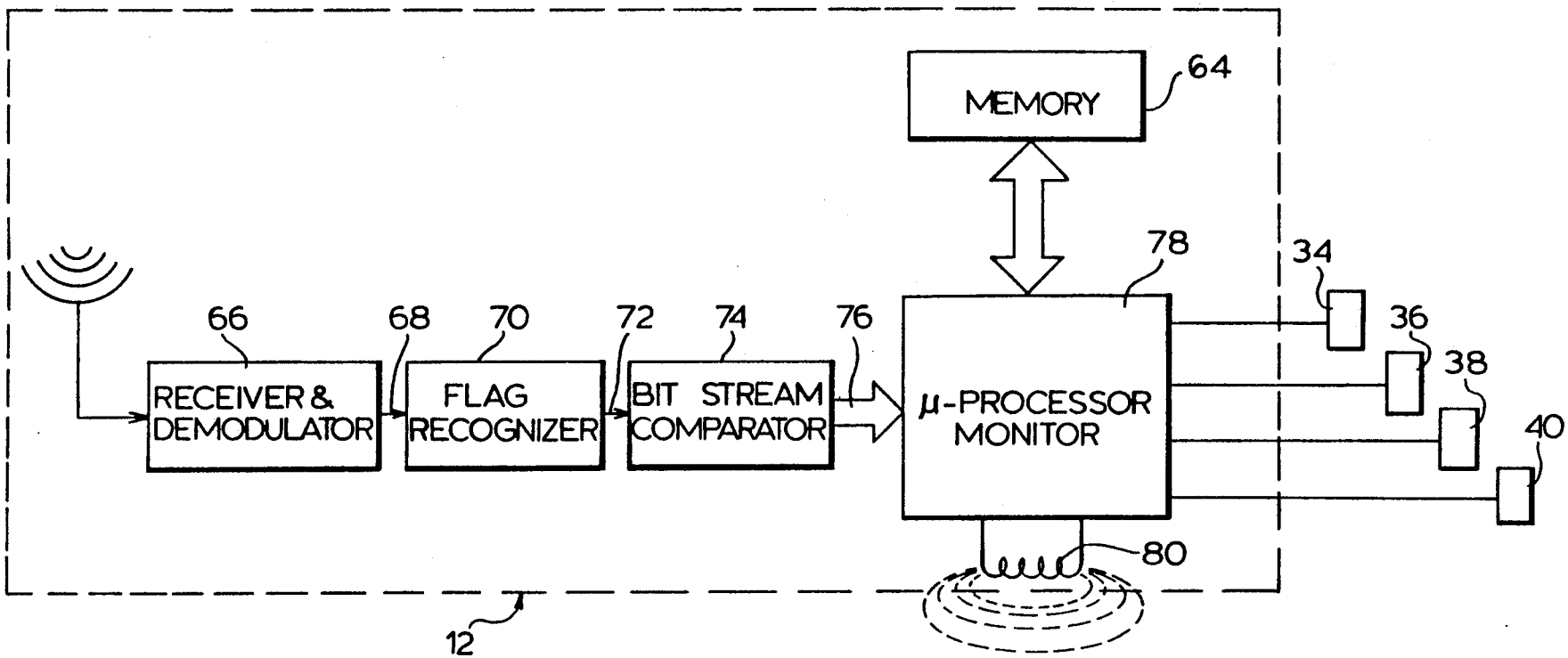
FIG. 4 is a schematic representation of the central monitor in accordance with the preferred embodiment.

Turning briefly to FIG. 4, a schematic representation of the central monitor 12 is provided. A receiver and demodulator 66 receives the signals transmitted by various sensors 14, 16, 18 and 20. The demodulator detects falling edges of the digital pulses generated by the UHF transmitter of microcontroller 50 (FIG. 3) to decode the received signal and output a signal on line 68 which corresponds with the bit stream produced by microcontroller 50 in a particular one of the sensors. The demodulated signal is then processed by flag recognizer 70 which searches for a unique delimiter flag sequence. Upon recognition of this flag bit pattern, the following 48 bits of information are separated from the received stream and passed down line 72 to bit stream comparator 74. The 48 bits of information contain the system identification number, module ID, check field 1, status and check field 2 transmitted by a particular transmitter. This information is stored in the bit stream comparator 74.

It will be appreciated that many transmitters from either one security alarm system or neighboring systems may transmit simultaneously and thus result in broadcast congestion and collisions which result in erroneous signals being received. Since each transmitter in either of these security alarm system itself or neighboring systems transmits synchronously and with periods of random length between the repeated frames, it is necessary to ensure that the information passed on by the flag recognizer 70 is correct. Many erroneous receptions due to overlap will be eliminated by the flag recognizer 70, but the possibility still exists for error in the subsequent 48 bits of information. Since the transmitters randomly repeat the frame of information being transmitted, it is possible to compare several transmissions and determine their correctness. To this effect, bit stream comparator 74 stores the most recent 32 bit streams passed on by flag recognizer 70. If a matching pair of bit streams can be found in the most recent 32 bit streams received, it is assumed that the transmission is correct. A copy of the matched bit stream is passed down bus 76 to a microprocessor 78 which is the principle part of the central monitor 12.

The microprocessor checks the first 11 bits of the bit stream received and determines if the information therein corresponds to the system identification number which has been stored in memory 64 of the central monitor 12. If the received system identification number corresponds to the stored system identification number, the remainder of the received information is processed and the correct response initiated. The sensor description, sensor location index and sensor location subindex and sensor status is compared with the information stored in memory 64 and depending upon the predetermined criteria, the appropriate alarm or alarms are actuated according to a predetermined response. The alarms include an outside horn 34, a telephone dialer 36, a voice synthesizer 38 and a trouble indicator 40. The home owner is alerted to the sensed alarm condition and appropriate corrective action may then be taken.

In accordance with the preferred embodiment microprocessor 78 also has a coil 80 connected to an I/O port thereof for generating a low intensity pulsed modulated magnetic field for programming the sensors 14–20, as will be described in greater detail below.

Returning to FIG. 3, during the normal operating mode of the sensors (e.g. sensor 16), the reed switch 58, 60 is interrogated or sampled every .25 seconds to detect if there is movement of the proximity magnet 61 carried by the appropriate door or window being monitored. More particularly, the reed switch 58, 60 is shown connected directly to an I/O line of microcontroller 50. Depending upon the programmed operating mode of the microcontroller 50, as dictated by the particular sensor to which it is connected (e.g. fire, door/-window, motion, etc.), the microcontroller 50 will expect receipt of signals characterized by a predetermined frequency for indicating an alarm condition. Thus, considering each sensor, signals presented to the appropriate microcontroller 50 change relatively infrequently during normal operation, and very rarely exhibit a repetition rate of more than a few tens of Hertz.

Therefore, in accordance with the present invention, the microcontroller 50 is used during normal operating mode to sample the state of the reed switch 58, 60 periodically, under control of an internal sampling timer in the usual fashion. However, rather than sampling the reed switch 58, 60 at the normal debounce period of approximately ten milliseconds, the microcontroller 50 samples the switch state on a more frequent basis (e.g. once every two milliseconds). Thus, debouncing is performed during normal operation of the sensor by taking a majority vote over a specified period.

However, in program mode, microprocessor 78 generates a high repetition rate magnetic pulse signal (e.g. 750 Hertz) via a coil 80. By positioning the sensor within the range of the localized magnetic field (e.g. 3 centimeters) the reed switch 58, 60 is actuated at the high repetition rate.

According to the preferred embodiment, microcontroller 50 samples the reed switch 58, 60 at a rate of 500 Hertz such that frequent changes in state will be perceived even though initially there is no synchronization between the sampling process and the switch actuation.

Synchronization between sampling and contact actuation is achieved in accordance with the present invention by the microcontroller 50 adjusting its sampling points. Upon achieving synchronization, the UHF transmitter of microcontroller 50 generates a response signal for reception by the central monitor 12. In this regard, microcontroller 50 generates an unmodulated carrier signal. Due to its proximity to the central monitor, the level of the signal from the module being programmed is sufficiently high by comparison to other modules in the system, which might transmit poll messages simultaneously with the programming routine, that the installed modules are effectively locked out of the receive channel of the central monitor.

Once synchronization has been established, microprocessor 78 generates a keyword via magnetic pulse signals through coil 80, which causes the microcontroller 50 to receive information sent to the sensor unit for storage in the internal EEPROM memory. Without this keyword, the microcontroller 50 will deny access to its data storage area, thus eliminating the possibility of accidental corruption of the stored information.

In addition, if a microcontroller 50 fails to receive proper modulations from the central monitor 12 within a predetermined period following establishment of synchronization, it will automatically drop out of the programming mode and enter a quiescent state.

As discussed above, the amount of data required for programming a sensor is set at 32 bits. This data is transmitted as contiguous bits, using a coding scheme such as pulse duration modulation.

Once synchronization has been established, the modulation rate may be increased to one kilohertz, which, using the proposed modulation scheme, would result in a data rate of approximately 330 bits per second. Hence, a total of 48 bits may be transmitted to the microcontroller 50 in approximately 146 milliseconds, although this period will be extended by the time required to establish synchronization between the sensor and central monitor 12. The time required to establish synchronization can be as great as 250 milliseconds, this being the interval between periodic interrupts.

According to the preferred embodiment, the programming process is terminated by an instruction from the central monitor 12 to the sensor. More particularly, the central monitor 12 preferably issues a signal or 2 bit command, causing the microcontroller 50 to take the received information from a temporary storage and write it into EEPROM. This technique is advantageous for two reasons: firstly, the sensor can never store incorrect data and secondly, the EEPROM write time of at least 10 milliseconds does not intrude upon the serial data transfer from central monitor to the appropriate sensor.

Thus, in accordance with the present invention, a robust programming loop is established such that the central monitor 12 has direct and immediate confirmation that the module or sensor 16 has received and stored uncorrupted data.

A person understanding the present invention may conceive of other embodiments or variations therein. For example, it is contemplated that Hall Effect, or other magnetic field detection devices may be substituted for the reed switch used in the preferred embodiment. However, the use of a reed switch is preferable for door/window sensors which can use the reed switch for a dual purpose (i.e. detecting proximity magnet movement during normal operation, and for receiving pulse position data in programming mode). All such embodiments and variations are believed to be within the sphere and scope of a invention as defined by the claims appended hereto.

I claim:

1. A method for non contact programming of a first device having memory means in accordance with a data signal produced by a second device, comprising the steps of:

a) generating at said second device a localized electromagnetic pulse signal corresponding to said data signal;

b) positioning said first device relative to said second device so as to effect electromagnetic coupling therebetween; and c) sampling and detecting said electromagnetic pulse signal at said first device and in response decoding and storing said data signal in said memory means, whereby said first device becomes programmed in accordance with said data signal.

2. The method of claim 1, further comprising the steps of:

d) generating said electromagnetic pulse signal at a first predetermined repetition rate;

e) sampling said electromagnetic pulse signal at a second predetermined repetition rate less than said first repetition rate; and f) adjusting said sampling to effect synchronization between said electromagnetic pulse signal and said sampling.

3. The method of claim 2, further comprising the steps of:

g) generating at said first device a response signal indicative of synchronization having been effected;

h) receiving said signal at said second device and in response generating a keyword within said data signal;

i) monitoring said decoded data signal at said first device for detection of said keyword; and j) in the event said keyword is detected within a predetermined length of time after generating said response signal then enabling storage of said data signal in said memory means; or k) in the event said keyword is not detected within said predetermined length of time then disabling storage of said data signal in said memory means.

4. The method of claim 2, further comprising the steps of increasing said first predetermined repetition rate to a further predetermined repetition rate upon effecting synchronization, thereby minimizing the time required to program said first device.

5. The method of claim 2, wherein said first predetermined repetition rate is approximately 750 Hertz.

6. The method of claim 2, wherein said second predetermined repetition rate is approximately 500 Hertz.

7. The method of claim 4, wherein said further predetermined repetition rate is approximately 1 kilohertz.

8. In a security alarm system comprising a central monitor and one or more programmable sensors, the improvement comprising:

a) means within said central monitor for generating a localized magnetic pulse signal defining data to be stored within said one or more sensors b) a reed switch within each said one or more sensors for sensing said localized magnetic pulse signal; and c) means within each said one or more sensors for decoding said data from said electromagnetic pulse signal sensed by said reed switch and in response programming said sensor in accordance with said data.

9. The improvement of claim 8 further comprising:

d) means within said central monitor for generating said magnetic pulse signal at a first predetermined repetition rate;

e) means within said one or more sensors for sampling the state of said reed switch at a second predetermined repetition rate less than said first repetition rate; and f) means within said one or more sensors for adjusting said sampling to effect synchronization between said magnetic pulse signal and said sampling.

10. The improvement of claim 9, further comprising:

g) means within said one or more sensors for generating a response signal indicative of synchronization having been effected;

h) means within said central monitor for receiving said response signal;

i) means responsive to receiving said response signal for generating a keyword within said data;

j) means within said one or more sensors for monitoring said decoded data for detection of said keyword, and in the event said keyword is detected within a predetermined length of time after generating said response signal then enabling said programming, or in the event said keyword is not detected within said predetermined length of time then disabling said programming.

11. The improvement of claim 10, further comprising means within said central monitor for increasing said first predetermined repetition rate to a further predetermined repetition rate upon receipt of said response signal, thereby minimizing the length of time required for programming said sensor.

12. The improvement of claim 9, wherein said first predetermined repetition rate is approximately 750 Hertz.

13. The improvement of claim 9, wherein said second predetermined repetition rate is approximately 500 Hertz.

14. The improvement of claim 11, wherein said further predetermined repetition rate is approximately 1 kilohertz.

15. The improvement of claim 8, wherein said means within said central monitor for generating said localized magnetic pulse signal comprises a solenoid coil.

16. The improvement of claims 9, wherein said means within said one or more sensors for generating a response signal comprises a UHF transmitter.

17. The improvement of claims 9, wherein said means within said central monitor for receiving said response signal comprises a UHF receiver.

18. The improvement of claims 8, further comprising memory means within each said one or more sensors for storing said data.

19. The improvement of claim 18, wherein said memory means is an EEPROM.

* * * * *